United States Patent [19]

Busch et al.

[11] 4,427,539

[45] Jan. 24, 1984

[54] DEMETALLIZING AND DECARBONIZING HEAVY RESIDUAL OIL FEEDS

[75] Inventors: Lloyd E. Busch; Gerald O. Henderson, both of Ashland, Ky.

[73] Assignee: Ashland Oil, Inc., Ashland, Ky.

[21] Appl. No.: 415,767

[22] Filed: Sep. 7, 1982

[51] Int. Cl.[3] ..... C10G 9/32; C10G 11/18

[52] U.S. Cl. ..... 208/127; 208/106; 208/113; 208/251 H; 208/253; 208/73; 208/91

[58] Field of Search ..... 208/127, 106, 251, 253, 208/73, 91, 107

[56] References Cited

U.S. PATENT DOCUMENTS

| | | | |
|---|---|---|---|
| 2,378,531 | 7/1945 | Becker | 208/91 |
| 2,462,891 | 3/1949 | Noll | 208/73 |
| 2,472,723 | 6/1949 | Peet | 208/91 |
| 2,800,433 | 7/1957 | Read | 208/93 |
| 4,167,471 | 9/1979 | Bertus et al. | 208/74 |
| 4,243,514 | 1/1981 | Bartholic | 208/91 |
| 4,263,128 | 4/1981 | Bartholic | 208/127 X |
| 4,309,274 | 1/1982 | Bartholic | 208/80 |
| 4,311,579 | 1/1982 | Bartholic | 208/73 |
| 4,325,809 | 4/1982 | Bartholic | 208/91 |
| 4,325,817 | 4/1982 | Bartholic | 208/91 |
| 4,328,091 | 5/1982 | Bartholic | 208/299 X |

*Primary Examiner*—Delbert E. Gantz
*Assistant Examiner*—G. E. Schmitkons
*Attorney, Agent, or Firm*—Richard C. Willson, Jr.; Carl D. Farnsworth

[57] ABSTRACT

The method and means for effecting selective visbreaking of residual oil feeds comprising metallo-organic compounds with a fluid solid sorbent particle material in the presence of process sour water and wet gas recycle material is described to provide a gas oil rich product more suitable for crystalline zeolite fluid catalytic cracking operations.

17 Claims, 1 Drawing Figure

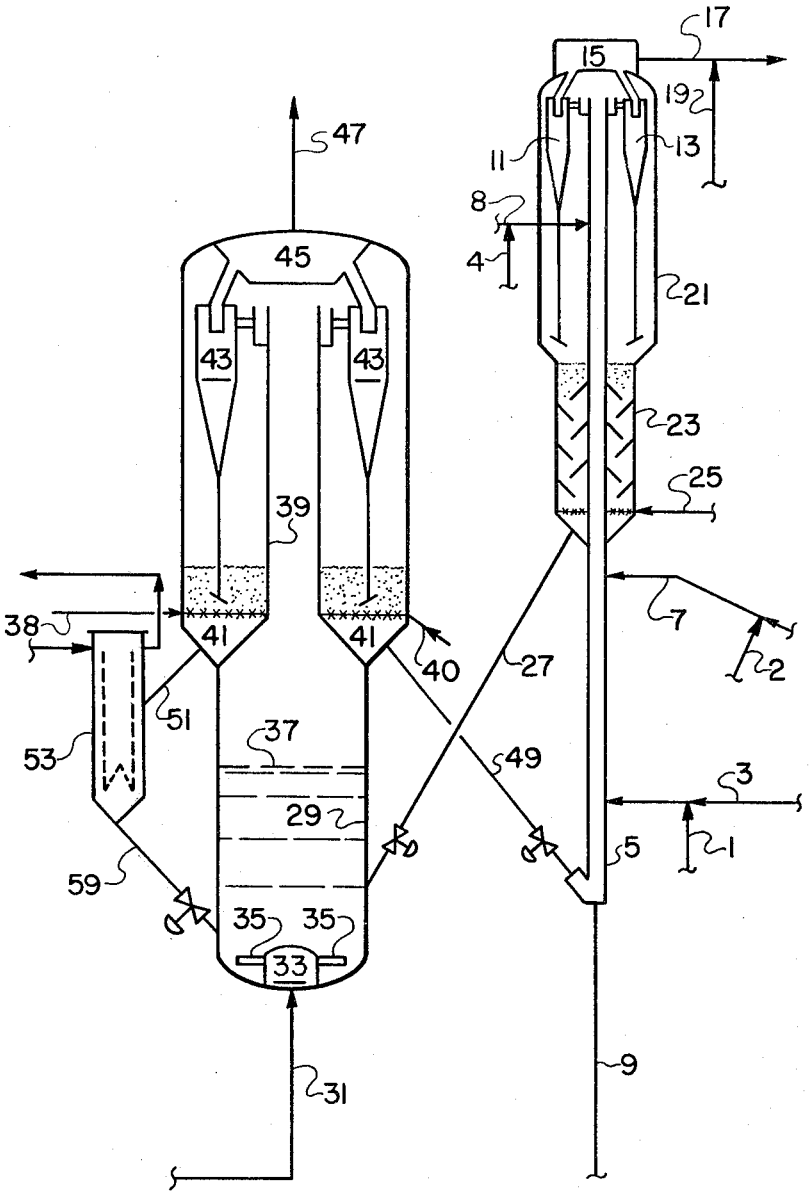
17
15
19
47
11
13
8
4
45
21
43
43
23
25
39
38
41
41
40
27
7
2
51
37
53
49
3
29
5
1
59
35
35
33
9
31

DEMETALLIZING AND DECARBONIZING HEAVY RESIDUAL OIL FEEDS

BACKGROUND OF THE INVENTION

It is well recognized by the petroleum refining industry that the higher boiling portions of crude oils and particularly that portion of the crude oil charged to vacuum distillation comprise a major portion of the contaminating metal compounds as well as carbon producing components referred to as Conradson carbon. More particularly, the metal bearing compounds and Conradson carbon components tend to be concentrated in the resid portion of crude oils boiling above about 552° C. (1025° F.). The metal contaminants in the crude oil feed and residual portions thereof comprise iron, nickel, vanadium and copper normally in the salt, oxide or metal form, depending on source. It is known that such metal contaminants rapidly deactivate cracking catalysts. Thus, until recently, relatively clean feeds reduced in metal contaminants and Conradson carbon producing components have been processed over the crystalline zeolite containing cracking catalyst. However, with the advent of crude shortage and high price, it has become necessary to process more of the crude barrel comprising the high boiling residual portion thereof known as resid or as a reduced crude. The effect of processing such higher levels of contamination metals and Conradson carbon producing component feed materials over active zeolite containing cracking catalyst normally employed for gas oil cracking is to increase the yield of dry gas and coke, rapidly destroy the active and expensive zeolite component and reduce yields of desired products such as gasoline and distillates.

An object of the present invention therefore, is to provide a process and method of operation which will provide a demetallized and decarbonized gas oil containing feed from crude oil and residual portions of crude oils in substantial higher yield and more suitable for processing over a downstream more selective and active crystalline zeolite containing fluid cracking catalyst. Another object is to obtain a heavy gas oil feed from crude oil more suitable for a fluid zeolite catalyst cracking process which will substantially reduce metal contaminant and Conradson carbon deposition on the zeolite cracking catalyst, whereby, dry gas and coke yield may be kept to a desired relatively low level. Another object of this invention is to provide an improved method for demetallizing and decarbonization a residual portion of crude oil to provide a more clean heavy oil feed for catalytic cracking upgrading over a gasoline selective crystalline zeolite containing fluid cracking catalyst. A still further object of this invention is to provide an improved and selective hydrovisbreaking operation providing substantial metals and Conradson carbon deposition and end boiling point reduction of the heavy oil charged thereto.

Visbreaking has been identified as a process where reduced crudes are pyrolized without substantial coke production. The process was initially developed to lower viscosities and pour points of residual oil feed stocks. Gasoline boiling range material and gas oils are produced with the amount of each, depending upon the type and severity of the operation employed. The products from any pyrolysis operation depends substantially upon the temperature, contact time and method of implementing the process. An object of the present invention is to provide a versatile but selective hydrovisbreaking operation for use in upgrading different or a combination of crude oil source materials to provide a more suitable feed for fluid zeolite catalytic cracking to high yields of desired product such as gasoline, gasoline precursors and light fuel oils. Other objects and advantages will be more apparent from the following discussion.

THE INVENTION

The invention is directed to the method and means for effecting a selective visbreaking upgrading of a poor quality relatively high boiling residual oil or reduced crude feed obtained from crude oil, oil shale and coal derived liquifaction products. More particularly, the invention is directed to decarbonizing and demetallizing crude oil feeds comprising components boiling above 553° C. (1025° F.) or 566° C. (1050° F.) and residual portions of topped crudes contributing Conradson carbon deposits by hydrovisbreaking under selected and restricted conditions arranged to produce a more suitable demetallized oil feed boiling below 566° C. (1050° F.) for catalytic conversion upgrading to gasoline products and gasoline precursors with an active crystalline zeolite for crystalline aluminosilicate containing fluid cracking catalyst.

In a more particular aspect, the present invention is concerned with upgrading crude oils, residual oil portions of crude oils comprising asphaltenes such as topped crudes and reduced crudes in a selective visbreaking or pyrolysis conversion operation synergistically cooperatively restricted to produce gas oils, lower and higher boiling components suitable for crystalline zeolite catalytic upgrading. The hydrovisbreaking operation of this invention is achieved under a relationship of conditions of contact time and temperature selected to achieve substantial thermal cracking of components boiling about 566° C. (1050° F.) to lower gas oil components in the absence of substantial naphtha production restrictions thereby achieving substantial decarbonizing and demetallization of the residual oil feed and thus the residual oil feed end boiling point.

The visbreaking operation of this invention accomplishes a thermal reduction in the crude oil feed end boiling point boiling above 566° C. (1050° F.) in an amount in the range of 60 to 100 percent and preferably at least a 80 or 90 volume percent reduction in end boiling point in a reducing atmosphere provided by recycled wet gas. Processing of the demetallized and decarbonized gas oil product thus obtained over an active zeolite containing fluid cracking catalyst is intended to be pursued in a separate downstream fluid catalytic cracking operation separate from the hydrovisbreaking operation of this invention.

HYDROVISBREAKING

In the operating environment of this invention, the visbreaking operation is accomplished in the presence of a $C_4$ minus gaseous product comprising hydrogen, known as wet gas recycle and a fluidizable solid particulate sorbent material of at least 0.2 cc/gm pore volume which may or may not have some but very little catalytic cracking activity. At least its catalytic cracking activity is less than suitable for gas oil cracking. The solid sorbent material may comprise some hydrogenation-dehydrogenation activity by virtue of deposited metal components on the sorbent from the residual oil feed such as iron, nickel, vanadium and copper. However, when employing the restricted but selective operating concepts of this invention, the hydrogenation-dehydrogenation activity of the deposited metals on the solids is considerably suppressed by the combination and by the $C_4$ minus wet gaseous product charged to the riser reactor. A recycled sour water product stream is, for example, mixed with the residual oil feed to assist with dispersion of the oil feed and provide a mix temperature within the range of 149° C. (300° F.) to 260° C. (500° F.) before being charged to the process and used as herein provided. The wet gaseous product ($C_4$ minus hydrocarbon product stream comprising hydrogen and hydrogen sulfide) is recovered from the quenched vaporous product of the visbreaking operation or from a separate fluid catalytic cracking operation. The sour water used is also obtained from the product of the visbreaking operation or it may be obtained from a separate downstream or other fluid catalytic cracking operation. The hydrovisbreaking operation wet gas recycle comprises substantial molecular hydrogen produced in the process which is recovered and recycled with or without treatment for removal of some sulfur components of the visbreaking operation. In a more particularly aspect, the selective visbreaking operation of this invention is accomplished in the presence of recycled wet gas providing a hydrogenating atmosphere in a riser reaction zone of selected dimensions to which hot solid particulate sorbent material is initially charged at an elevated temperature in the range of 704° C. (1300° F.) up to about 871° C. (1600° F.). The charged hot solid is mixed with a relatively cool compressed recycled wet gas product stream of less than 66° C. (150° F.) herein defined in the bottom of the riser to form an upflowing solids-gaseous material suspension stream of predetermined and selected elevated temperature depending on solids content before contact with a sour water-residual oil feed mixture to be selectively upgraded in a downstream restricted portion of a riser contact zone. The presence of sulfur and the $C_4$ minus hydrocarbons including hydrogen in the recycled wet gas is desirable to effect a partial reduction of metal oxides collected on the sorbent and formed during regeneration of the sorbent by burning combustibles. Some metal sulfides and carbides are also formed thereby further suppressing the deactivating effects of the metals before contacting the heavy residual oil feed. The recovery of sour water at a temperature of about 38° C. (100° F.) is admixed with heavy oil feed to aid with atomized dispersion contact of the heavy oil feed with the wet gas suspension of solids formed as above provided. The residual oil feed recovered from an atmospheric distillation tower may be charged as recovered but preferably is cooled to a lower temperature so that upon mixture with sour water, the mix temperature will be within the range of about 149° C. (300° F.) to about 260° C. (500° F.), preferably about 163° C. to 204° C. (325° to 400° F.).

The selective process of this invention is economically attractive since it provides more decarbonized and demetallized feed from the crude barrel without a need to provide high temperature steam for admixture with the residual oil feed charged to the visbreaking operation of this invention. The selective upgrading of the residual oil feed as herein provided and comprising decarbonizing and demetallizing thereof reduces the feed viscosity but more importantly its end boiling point to gas oil components boiling below 553° C. (1025° F.) or 566° C. (1050° F.). The hydrovisbreaking operation of this invention is effected with fluidizable solid sorbent particle material less than 100 micron particle size which may or may not comprise some catalytic cracking activity under selected operating parameters constrained to particularly thermally crack components of 5 or more ring components to components of 4 or less rings and also obtain some thermal cracking of the residual oil feed boiling below 552° C. (1025° F.) to thermally produced naphtha. Thus, it is preferred to thermally visbreak a 566° C. (1050° F.) plus crude oil fraction in a time-temperature relationship accomplishing conversion by at least 70 or 80% to components boiling below 566° C. (1050° F.). The decarbonization and demetallization of the residual oil feed to produce particularly a gas oil boiling range product of increased yield and reduced viscosity is accomplished with a relatively high pore volume solid sorbent material of at least 0.2 cc/gm in the presence of metals accumulation up to about 20,000 ppm but preferably not above about 17,000 ppm.

CRACKING CONDITIONS

The selective visbreaking operation of this invention is effected in the presence of hydrogen containing wet recycle gas admixed with solid particle sorbent material in a concentration up to 100 to 1 to form a suspension before contact with residual oil feed and to provide a thermal visbreaking temperature with hot solid sorbent material at the riser outlet after a contact time less than 2 seconds within the range of 482° C. (900° F.) or 510° C. (950° F.) up to abot 566° C. (1050° F.) or 593° C. (1100° F.). Preferably, the suspension sorbent-vaporous material temperature at the riser outlet is between about 516° C. (960° F.) and 538° C. (1000° F.) so that thermal visbreaking of the feed to gas oil product can be particularly pursued in combination with obtaining reduction of the feed end boiling point to at least 566° C. (1050° F.) in the presence of the hydrogen rich wet gas atmosphere herein identified. An important operating parameter in addition to temperature restrictions to reduce the feed end boiling point as desired and yet restrain unnecessary visbreaking to thermal naphtha is directed to limiting or restricting the contact time between solids, residual oil feed and diluent material in the riser at the elevated temperature to less than 2 seconds and more susally in the range of 0.5 second to about one second. Thus, it is essential to obtain rapid atomized dispersion contact of residual oil feed with the upflowing suspension in the riser and rapid separation of the suspension at the riser discharge. Vaporous visbreaker product separated from solids is then rapidly quenched before separation by distillation. Various feed nozzle arrangements such as atomizing spray nozzle techniques known in the prior art may be employed in conjunction with suspension separation techniques known in the art to achieve the limited thermal conversion desired. It is preferred however to employ the ballistic separation technique of U.S. Pat. Nos. 4,066,533 and 4,070,159 and copending application 06/304,992, filed May 13, 1981.

METALS

The hydrovisbreaking operation of the invention contemplates a conversion of 566° C. (1050° F.) plus residual oil feed material of at least 60% and preferably at least 80 to 90% with a metals removal level in the range of at least about 90% up to about 95% when accumulating metals on the fluidizable particulate solid sorbent material up to about 17,000 ppm. The sorbent particulate material employed in this visbreaking operation may be replaced with fresh sorbent material free of metal deposits or by a lower metals containing solid particulate material by withdrawal and addition at a rate commensurate with providing or maintaining an equilibrium level of metal contaminants on the solid sorbent not exceeding about 20,000 ppm and preferably not exceeding about 15,000 up to 17,000 ppm Ni equivalent.

PARTICULATES

The sorbent particle material employed in the operation of this invention is normally considered to be catalytically inert of of very little if any catalytic activity and may be selected from substantially any one of a number of materials disclosed herein and in the prior art.

Preferably, the sorbent particle material is of a relatively high pore volume of at least 0.2 cc/gm and more preferably at least 0.4 cc/gm pore volume. Such a material may be calcined kaolin or other relatively inexpensive high pore volume material. The solid sorbent may be a spent or deactivated amorphous or inactivated zeolite containing cracking catalyst which will be effective for the purpose at the herein disclosed visbreaking conditions. Achieving any substatial catalytic cracking of the residual oil feed in the presence of the solid sorbent particulate comprising metal contaminants is not particularly desired or anticipated.

Finely divided solid sorbent materials which may be employed are various clays such as kaolin, kieselquhr. pumice, diatomaceous earths, decolorizing clays, finely divided alumina or bauxite. Cracking catalyst of little or no activity of synthetic or natural origin are also useful in the process since they are readily available from a downstream fluid catalyst cracking operation or other source of such material. A mixture of spent cracking catalyst particles and clay type particles may also be employed as the sorbent.

HYDROGEN-CONTAINING GAS

The hydrogen contributing $C_4$ minus recycle wet gas defined in the table below will however operate to modify the hydrogenation-dehydrogenation activity of the metals loaded solid particulate when the deposited metals of iron, nickel, vanadium and copper are partially reduced or changed to a lower oxide state, a metal sulfide or a carbide form.

WET GAS RECYCLE COMPOSITION TABLE

| | Normal | Rated |
|---|---|---|
| Nitrogen | 5.79 | 5.79 |
| Water Vapor | 6.02 | 6.02 |
| Carbon Monoxide | — | — |
| Carbon Dioxide | 0.90 | 0.90 |
| Hydrogen Sulfide | 2.16 | 2.16 |
| Hydrogen | 12.48 | 12.48 |
| Methane | 20.16 | 20.16 |
| Ethylene | 14.18 | 14.18 |
| Ethane | 9.87 | 9.87 |
| Propylene | 11.47 | 11.47 |
| Propane | 4.43 | 4.43 |
| Butane | 0.40 | 0.40 |
| Butane | 0.82 | 0.82 |
| Pentane | 0.22 | 0.22 |
| Pentane | 0.30 | 0.30 |
| Mexane Plus | 2.90 | 2.90 |
| $C_4$ = | 7.90 | 7.90 |
| TOTAL | 100.00 | 100.00 |

-continued

WET GAS RECYCLE COMPOSITION TABLE

| | Normal | Rated |
|---|---|---|
| AVERAGE MOL. WT. | 29.66 | 29.66 |

The ratio of solid sorbent material to residual oil feed employed may be within the range of 1 to 15, preferably from about 4 to 10, ti being preferred to increase the ratio as the level of Conradson carbon and contiminating metals increase in the residual oil feed.

It is also important to restrict the level of carbonaceous material deposit on any given particles of sorbent material so that regeneration thereof by burning may be accomplished rapidly and provide an adequate heat sink by the sorbent solids. Furthermore, controlling the temperature of the solids regeneration operation is more easily facilitates by employing a relatively large volume of solid sorbent comprising a lower level of deposited carbonaceous deposit on each solid particle whether accomplished in a single or multiple stage regeneration operation.

RISER

One of the important aspects of the residual oil decarbonizing and demetallizing process herein defined is particularly directed to providing a number of different residual oil feed inlet or injection points along the length of the riser reaction zone and employed in the manner herein provided to restrict residence contact time between oil feed and solids. That is, the residual oil feed depending upon composition may be charged adjacent to a lower bottom portion of the riser but above the fluidizable solids and suspension forming gas inlets. It may also be charged to an intermediate portion of the riser substantially vertical length and below an annular stripping zone about an intermediate portion of the riser, or it may be introduced to an upper portion of the riser and above the annular stripping zone. By this multiple feed inlet selection arrangement, it is intended to provide the operator with means for restricting the oil feed residence time within the riser within limits desired as herein provided over a variety of suspension space velocity conditions as the mixture of solids, wet gas and oil feed pass upwardly through the riser. Thus, it is particularly contemplated emplying elevated temperature plug flow suspension velocities in the riser over the range of about 50 to about 100 ft./second, it being preferred to restrict the suspension velocity discharged from the open upper end of the riser at a velocity not exceeding about 85 feet per second. A suspension velocity which will particularly facilitate rapid separation of the suspension of vapor-solids components such as by a function of momentum differential or by the techniques of centrifugal or ballistic separation is desirable. Other techniques known in the art and suitable for the purpose may also be employed for rapidly separating the suspension following traverse of the riser contact zone. It is important, however, to optimize the particular contact time-temperature relationship as herein defined to achieve the selective visbreaking conversion operation to desired gas oil materials boiling below 566° C. (1050° F.). The selective visbreaking operation if further enhanced by employing a solids to oil ratio of at least about 5; by charging relatively cool residual oil feed to the wet gas suspension of solids of selected temperatures depending on particle concentration ratio in wet gas up to 100 to 1 and by restricting the state of deposited metal contaminants providing hydrogenation-dehydrogenation activity functions.

The fluidizable solid particle material with or without some catalytic cracking activity and comprising deposited metal contaminants is preferably of a particle size within the range of 10 to 200 microns and more usually within the range of about 40 to about 100 microns at least when initially charged to the visbreaking operation comprising a fluid solids riser reaction contact zone and a fluidized solids regeneration system. Particle attrition will tend to occur during the cyclic movement in the thermally varied system comprising mixing a relative low temperature recycle gas with hot solid particles, effecting the high velocity hydrovisbreaking operation, time and temperature restrictions as herein provided followed by variations in temperatures encountered in a stripping zone and solids regeneration zone in the range of 482° C. (900° F.) up to about 927° C. (1700° F.).

STRIPPING

Stripping of the solids with steam to remove entrained vaporous material may be at a temperature equal to, above or below the temperature at the discharge of the riser contact zone. On the other hand, regeneration of the solids comprising carbonaceous deposits mixed with metal deposits, sulfur and nitrogen will encounter temperatures substantially above 704° C. (1300° F.) and up to as high as about 871° C. (1600° F.) or 927° C. (1700° F.).

REGENERATION

The regeneration operation provided with the fluid solids visbreaking operation of this invention may be a single dense fluid bed stage or a multi-bed stage regeneration operation in cooperation with dispersed phase solids regeneration which may be substantially varied in operational utilization. That is, the stripped fluid sorbent solids are regenerated in at least one dense fluid bed particle contact zone at a desired elevated temperature of at least 677° C. to 704° C. (1250° F. to 1300° F.) with a suitable oxygen enriched air, air admixed with steam or a synthetic regeneration gas mixture comprising oxygen and steam. The dense fluid bed operation may be used to effect complete or partial removal of carbonaceous deposits to provide regenerated solid of desired temperature. Partially regenerated solids may then be passed to a second dense fluid bed phase or be passed upwardly from the upper interface of the first dense fluid bed phase through an elongated confined riser contact zone as a dispersed solids phase in the presence of flue gas combustion product of said first dense bed contact. The flue gas combustion products may or may not comprise combustion supporting amounts of one or both oxygen and CO. On the other hand, combustion of formed CO may be made to occur in either or both the dense bed or the riser contact zone and at least in the riser contact zone by providing sufficient oxygen to the dense bed phase for the purpose or charged separately to the riser above the dense bed interface. The generally upflowing solid particle flow through the dense bed phase and dilute riser phase is temperature monitored to restrict the ultimate temperatures encountered not to exceed desired upper limits of about 871° C. (1600° F.) to 927° C. (1700° F.) and more usually the temperature is less than about 816° C. (1500° F.) or 871° C. (1600° F.). Following traverse of the riser portion of the solids regeneration operation, the solids either partially or completely regenerated by combustion removal of carbonaceous deposits are separated from flue gases and collected, in one particular embodiment, as a second dense annular fluid bed of solid particle material. In the event, however, an undesired amount of residual coke (carbon) remains on the solids upon reaching the second dense fluid bed of solids, oxygen containing fluidizing or fluffing gas such as air charged to a bottom portion of the second dense bed of solid particles may be employed to effect further combustion removal of any residual carbon on the solids at a high temperature. This second stage of dense bed solids regeneration if effective when restricting the temperature rise in the preliminary regeneration steps above identified and when employing a relatively low concentration of particles in the upflowing solids stages of regeneration or when a steam-oxygen mixture is first employed to initially regenerate the generally upflowing mass of solids. The temperature of the second dense bed of solids is normally equal to or above the first stage of solids regeneration. On the other hand, some cooling of the annular bed of regenerated solids may be accomplished with the fluffing or fluidizing gas when desired.

In the regeneration cycle of this invention, hot solid particles collected and maintained as a second dense fluid bed of solids with oxidizing gas substantially complete the oxidation of deposited metals at an elevated temperature. A portion of these hol solids with oxidizing gas substantially complete the oxidation od deposited metals at an elevated temperature. A portion of these hot solids are relied upon for producing high pressure steam by indirect heat exchange with boiler feed water preferably external to the regeneration zones whereby the regenerated solids are partially cooled to a temperature within the range of 649° C. (1200° F.) to 760° C. (1400° F.) before recycle to the first dense bed of solid particles initially regenerated with oxygen containing gas as herein provided. Separate portions of the high temperature solids collected in the second dense fluid bed of solids are withdrawn for recycle or passage to the first dense bed of solids to be regenerated without cooling and/or passage to the riser visbreaking contact zone for use as more particularly discussed herein.

On the other hand, a single stage relatively dense fluid bed solids regeneration operation may be employed wherein regeneration temperatures are sufficiently high to achieve relatively rapid removal of deposited carbonaceous material to a residual coke level below about 0.25 weight percent, more susally not above 0.15 weight percent without exceeding a temperature of 871° C. (1600° F.) or 927° C. (1700° F.).

BRIEF DESCRIPTION OF THE DRAWING

The drawing is a diagrammatic illustration in elevation of a fluid solids contact zone comprising a riser visbreaking zone, a stripping zone, a sequential combination of solids regeneration zones and interconnecting transfer conduits permitting the cyclic flow of solids through the sequence of contact zones as herein provided.

SPECIFIC EMBODIMENTS

Referring now to the drawing by the way of example, there is shown one arrangement of a side-by-side reactor-regenerator apparatus or means suitable for effecting visbreaking contact of a residual oil or reduced crude feed with a fluidizable solid sorbent material maintained under operating conditions selected to accomplish metals removal and reduce the level of Conradson carbon producing components of the feed from about 6 or 8 to about 2. The solids contact system of the drawing is particularly concerned with a hydrovisbreaking operation comprising a riser contact zone for selectively contacting the heavy residual oil feed comprising metal contaminants with a fluid solid sorbent particulate material such as a kaolin clay solids particulate material or spent catalyst particles of little or no catalytic cracking activity for a time less than 2 seconds at a temperature restricting the riser outlet temperature to within the range of about 516° C. (960° F.) to about 593° C. (1100° F.) and more usually not above about 566° C. (1050° F.) under space velocity conditions selected to accomplish substantial metals deposition on the sorbent and visbreaking of 566° C. (1050° F.) plus material as herein provided. Thus, the essence of the visbreaking operation is directed to hydrovisbreaking a residual oil so that particularly multi-ring compound boiling above 552° C. (1025° F.) or 566° C. (1050° F.) are reduced to 4 or less ring compounds without substantially restricting the formation of naphtha boiling components and gasoline precursors. However, it is also desirable to optimize formation of multi-ring compounds boiling below 553° C. (1025° F.). In the specific arrangement of the drawing, a sour water product of the process recovered at a temperature of about 38° C. (100° F.) to about 52° C. (125° F.) or 66° C. (150° F.) is added in one specific embodiment by conduit 1 to a reduced crude or residual oil product of atmospheric distillation to form a mix temperature thereof in the range of 149° C. to 204° C. (300° F. to 400° F.) or about 260° C. (500° F.). This residual oil-sour water mixture is added in this specific embodiment by conduit 3 to an upwardly flowing initially formed suspension in riser reactor 5 and to the riser above the bottom portion thereof. On the other hand, when desired to further limit the oil contact time in the riser, the oil-sour water mixture may be added by either downstream inlet conduits 7 or 8 for the purpose of more severely limiting the oil feed residence time to a fraction of a second in the riser. A lift gas comprising recycled $C_4$ minus wet gas above defined of relatively low temperature not substantially above about 38° C. (100° F.) or 66° C. (150° F.) and obtained from a main column overhead gas product separator drum not shown is introduced by conduit 9 to the riser bottom and admixed with circulated hot solid particulate in conduit 49 recovered from the regeneration operation at a temperature in the range of 760° C. (1400° F.) up to 871° C. (1600° F.) or 927° C. (1700° F.) and charged to a bottom portion of riser 5. The amount of relatively cold $C_4$ minus wet gas recycle charged as lift gas to form a suspension with hot solids aids with dispersing the heavy oil in contact with solid particles, and rapidly forms an upflowing suspension of acceptable properties by partially cooling the temperature with the hot solids depending on solids concentration and temperature obtained from the regeneration operation. The sour water addition is believed to partially reduce metal oxides to a lower valence state in addition to forming sulfides or carbides thereof as the formed suspension at a solids to lift gas ratio in the range of 60 to 100 to 1 moves upwardly throught an initial portion of the riser at an acceptable high temperature and space velocity for downstream contact with the cooler residual oil and sour water feed mixture herein described. This combination of wet lift gas admixed with hot regenerated solids also permits forming a suspension of particularly desired elevated temperature and metals oxidation state. It also permits establishing a predetermined and desired suspension verticla velocity component up to 100 feet per second before contact with the dispersed residual oil and sour water feed mixture in the riser under selected velocity, temperature and time restricted hydrovisbreaking conditions providing the degree of visbreaking conversion particularly desired. The residual oil vaporized feed and thermal product thereof is preferably at a temperature permitting a riser discharge temperature in the range of 518° C. (965° F.) up to 566° C. (1050° F.)±10 degrees which is recovered from riser 5 at a relatively high velocity. The hydrocarbon residence time in contact with hot sorbent particles is less than 2 seconds and preferably within the range of about 0.5 to about 1 second. The riser 5 contact zone is provided as mentioned above with a plurality of vertically spaced apart feed inlet means 3, 7 and 8 to which sour water is added by conduit 1, 2 and 4. A selection of one of the feed inlet conduits permits changing the hydrocarbon-solids residence time as herein desired. The suspension formed under the restricted hydrovisbreaking conditions selected, pass through riser 5 for discharge from the top or open upper end of the riser for ballistic separation or other means so that decarbonized and demetallized vaporous gas oil hydrocarbons of lower end boiling point obtained by the visbreaking operation can flow through two or more parallel arranged cyclone separators 11 and 13 in open communication with an annular product vapor collecting cup positioned about the upper open end of the riser contact zone. Hydrocarbon vapors separated from entrained solid by the cyclone separators are rapidly passed through a plenum chamber 15 before quenching with a suitable quench fluid below thermal cracking thereof and withdrawal by conduit 17 at a temperature of about 521° C. (970° F.) or lower for passage to a main column fractionator not shown. The vaporous product material of visbreaking in conduit 17 may be quenched in one specific embodiment to a temperature as low as about 360° C. (680° F.) by admixture with a portion of the main fractionator column bottoms product not shown.

Solid particulate material such as calcined kaolin or other suitable sorbent particulate material and comprising accumulated metal deposits with deposited carbonaceous material are collected in a bottom portion of vessel 21 for downflow passage to and through an annular stripping section 23 to which stripping gas such as steam, $CO_2$ or a mixture thereof is charged by conduit 25 at a temperature of at least about 204° C. (400° F.) up to a temperature of or above the solids discharge temperature from the riser. Stripping temperatures up to about 566° C. (1050° F.) are contemplated. Stripped solid absorbent particulate material comprising deposited metal contimianats are thereafter passed by stanpipe 27 provided with a flow control valve to a lower portion of a relatively dense generally upflowing relatively dense fluid mass of particulate solids in a bottom portion of a first dense fluid bed regeneration zone 29 in open communication with an upper restricted diameter elongated dispersed fluid solids phase regeneration section. A rather vague solids interface 37 between the dense bed and upper dispersed phase if formed because of the upflowing solids and will vary in definition depending on the solids concentration in regeneration gas and velocity conditions employed. Regeneration gas such as an oxygen modified gas or air with or without steam or added oxygen is charged to a bottom portion of the regeneration zone by conduit 31 through a plenum distribution chamber 33 supporting a plurality of radiating gas distributor pipes 35. Regeneration of the sorbent particulate by burning deposited carbonaceous material is accomplished at least in part of substantially completely in the bulb-riser regeneration system of the drawing at a particle concentration within the range of 3 to 35 pounds per cubic foot and a temperature above 649° C. (1200° F.) up to about 871° C. (1600° F.) or 927° C. (1700° F.). Either an oxygen lean or restricted oxygen containing gas atmosphere promoting the combustion of carbonaceous material and the formation of carbon oxides such as a (CO) carbon monoxide ($CO_2$) carbon dioxide regeneration flue gas mixture is employed and the CO content of the flue gas may be varied by the amount of $O_2$ charged. Combustion product gases and sorbent solids pass overhead as a suspension from the large bulb shaped dense fluid 39 of restricted diameter as a less dense or dispersed suspended mass of particulate in flue gases with or without combustion supporting amounts of CO and $O_2$ for discharge and separation about the upper open end of riser 39 by suitable means such as by ballistic separation techniques herein identified. The upper enlarged portion of the regeneration vessel permits separation to be made between discharged solid particulate and product flue gases by the combination of momentum differential or ballistic separation technique in combination with hindered settling and cyclone separator means. The separator particulate is collected as a relatively dense fluid annular bed or mass or material 41 at a high temperature up to 927° C. (1700° F.) in an annulary cup positioned about the open upper end of passageway 39 for removal of flue gases with some entrained fines. The technique of ballistic separation is preferred to reduce solid particle loading of the cyclones. Flue gases are passed through a plenum chamber 45 for withdrawal therefrom by conduit 47 and passage to a steam generating zone such as a CO boiler. Regenerated fluid solid sorbent particulates at an elevated temperature within the range of 760° C. (1400° F.) to 927° C. (1700° F.) may be further contacted with $O_2$ containing gas introduced by conduits 38 and 40 before being withdrawn by standpipe 49 for passage to the bottom portion of riser 5 for use as herein discussed. A portion of the hot regenerated sorbent is also withdrawn by conduit 51 for passage to an indirect heat exchanger 53 wherein relatively high pressure steam is particularly generated by indirect heat exchange with charged boiler feed water introduced by conduit 55. The steam generated is recovered by conduit 57 for use as desired in a refinery operation. The solids are partially cooled in the heat exchanger before recycle to the bed of solids initially contacted with regeneration gas. The thus partially cooled solid particulate is withdrawn by conduit 59 for passage to a lower portion of zone 29 comprising a dense fluid bed or mass of solid particulate being rengenerated for admixture with charged cool solids by stanpipe 27 comprising carbonaceous material in a bottom portion of regeneration zone 29 thereby maintaining the temperature of the bed with charged stripped solids sufficiently high to rapidly initiate combustion of carbonaceous deposits. Temperature control may also be exercised by restricting the amount of oxygen in the regeneration gas charged and by mixing in inert gas such as $CO_2$ therewith introduced by conduit 31 to distributor 35 with arms 35. It is contemplated charging a portion of the temperature reduced solids in conduit 59 directly to the bottom of riser 5 with or without the solids in conduit 49. Provisions not shown are also contemplated for passing solids in conduit 49 to the bed of solids in zone 29 comprising a first stage of regeneration.

Having thus generally described the hydrovisbreaking operation of this invention and described a specific operation in support thereof, it is to be understood that no undue restrictions are to be imposed by reasons thereof except as defined by the following claims.

Copending U.S. Ser. Nos. 06/304,992; 06/355,661; and 06/288,572 are related and are hereby incorporated by reference.

What is claimed is:

1. In a process for visbreaking a residual oil portion of a crude oil with solid sorbent particle material of little or no catalytic cracking activity to produce a demetallized and decarbonized product comprising gas oils suitable for crystalline zeolite catalytic conversion to gasoline boiling range material, the improvement which comprises, contacting the residual oil portion of a crude oil with an initially formed upflowing high temperature suspension of solid sorbent particulate material in a normally gaseous $C_4$ minus product of the process rich in hydrogen in a time-temperature relationship particularly accomplishing hydrovisbreaking of 566° C. (1050° F.) plus boiling material to produce material boiling below 552° C. (1025° F.) comprising decarbonized and demetallized gas oil boiling range product without substantial restriction on the amount of thermal naphtha produced, restricting the contact time between solids and charged residual oil to less than 2 seconds in the upwardly flowing suspension and; recovering a vaporous gas oil containing product of the visbreaking operation at a temperature in the range of 516° C. (960° F.) to 593° C. (1100° F.) separated from a major portion of the solid sorbent material.

2. In a process for selectively hydrovisbreaking reduced crude to produce increased yield of materials boiling below 552° C. (1025° F.) comprising gas oils, the improvement which comprises, forming an upflowing high temperature suspension of clay-type solid sorbent particle material in a $C_4$ minus gaseous stream comprising hydrogen in the lower portion of a riser contact zone, adding sour water to a reduced crude oil feed to form a mix temperature thereof in the range of 149° C. to 260° C. (300° F. to 500° F.) before contact thereof with said upflowing high temperature suspension comprising solid sorbent particles in said riser contact zone, maintaining said reduced crude in contact with said solid sorbent for a time in the range of 0.5 up to 2 seconds before separating vaporous gas oil containing products of said selective visbreaking operation from solid sorbent material, separating a $C_4$ minus product stream rich in hydrogen and a sour water stream for reuse in the process from vaporous hydrocarbon products boiling below 552° C. (1025° F.), and recovering decarbonized and demetallized hydrocarbon products of said visbreaking operation.

3. A method for upgrading a residual portion of crude oil comprising components boiling above 552° C. (1025° F.) which comprises, forming a upflowing suspension of catalytically spent solid sorbent particle material recovered from a regeneration zone at a temperature in the range of 760° C. to 871° C. (1400° F. to 1600° F.) in a $C_4$ minus reducing wet gaseous product stream, charging said residual portion of crude oil admixed with sour water and providing a mix temperature thereof below about 260° C. (500° F.) in contact with said upflowing suspension of solid sorbent material providing a ratio of solid sorbent particles to oil feed in a ratio of 5–15 to 1 for a contact time less than 2 seconds, recovering a product stream of said thermal conversion operation at the discharge of a riser contact zone at a temperature below 593° C. (1100° F.) and effecting immediate separation thereof into a vaporous product stream and a stream of solid particles comprising metal deposits admixed with carbonaceous deposits, quenching vaporous products separated from solid particles and recovering the quenched vaporous products for separation and recovery of $C_4$ minus wet gaseous material and a sour water product from higher boiling hydrocarbons comprising gas oils, and passing separated solid particles to a regeneration zone for removal of carbonaceous products by combustion thereby heating the particles to an elevated temperature suitable for forming said suspension.

4. A method for decarbonizing and demetallizing a residual oil product of crude oil distillation comprising metallo-organic compounds and Conradson carbon producing components boiling above 566° C. (1050° F.) which comprises, contacting said residual oil product with a formed high temperature suspension of $C_4$ minus wet gas comprising hydrogen and a solid sorbent fluid particulate of little if any catalytic activity in a riser contact zone under operating conditions of space velocity, time of hydrovisbreaking of multi-ring hydrocarbon components boiling above 566° C. (1050° F.) to lower order ring compounds boiling below 566° C. (1050° F.) in the absence of imposing a substantial restriction on the production of thermal naphtha, recovering a product of said hydrovisbreaking operation separated from solid sorbent particulate comprising gas oil boiling range components reduced in metal contaminants and Conradson carbon producing compoenets, and removing carbonaceous products of said visbreaking operation from separated solid sorbent particulate by combustion in a regeneration zone.

5. The method of claim 4 wherein the hydrovisbreaking operation in the riser is restricted to a contact time less than 2 seconds and riser discharge temperature in the range of 510° C. (950° F.) up to about 566° C. (1050° F.) when contacting the suspension formed from regenerated solids at a temperature in the range of 760° C. (1400° F.) to 871° C. (1600° F.) with wet gas recycle at a temperature below about 66° C. (150° F.).

6. The method of claim 5 wherein the initially formed suspension of solid sorbent particulate and wet gas is up to 100 to 1 and the ratio of solids to vaporous material following contact with residual oil is in the range of 5 to 10.

7. The method of claim 4 wherein the solid sorbent particulate is substantially completely free of catalytic cracking activity.

8. The method of claim 4 wherein the solid sorbent particulate comprises some catalytic cracking activity but insufficient for use in a gas oil catalytic cracking operation.

9. The method of claim 4 wherein the carbonaceous products of said hydrovisbreaking operation are removed from the solid sorbent material by combustion with oxygen containing gaseous material in a regeneration operation comprising one or more dense fluid bed contact phases with or without a dispersed solid contact phase intermediate thereto.

10. The method of claim 4 wherein the solid sorbent particulate to be regenerated is initially mixed with hot regenerated solid particles in a first dense fluid bed phase before passage through a dispersed solids phase, the combination of which heats the solids to an elevated temperature in the range of 760° C. to 871° C. (1400° F. to 1600° F.) and reduces the level of residual carbon on the solids below about 0.25 weight percent.

11. The method of claim 10 wherein the solids initially regenerated in the dense and dilute phases are collected as a second dense bed of solids maintained fluid by oxygen containing gas at a temperature of at least 760° C. (1400° F.) whereby insufficiently removed residual carbon is removed by burning.

12. In a process for upgrading high boiling hydrocarbons comprising metal contaminants and/or Conradson carbon producing components boiling above 566° C. (1050° F.) by non-catalytic thermal visbreaking, the improvement which comprises, forming a upflowing suspension from solid sorbent particle material at a regeneration temperature in the range of 760° C. to 871° C. (1400° F. to 1600° F.) admixed with a hydrogen containing wet gas $C_4$ minus product of the visbreaking operation in a bottom portion of a riser contact zone of high solids content, admixing sour water obtained from the visbreaking process with said high boiling hydrocarbon to form a mix temperature thereof in the range of 149° C. to 260° C. (300° F. to 500° F.), passing said sour water-high boiling hydrocarbon mixture in contact with said upflowing suspension for a time restricting the temperature at the riser outlet within the range of 510° C. to 566° C. (950° F. to 1050° F.) whereby substantial hydrovisbreaking of the 566° C. (1050° F.) plus components to components boiling below 566° C. (1050° F.) is accomplished by at least 90 percent, separating and recovering vaporous hydrocarbons of said hydrovisbreaking operation from solid particle sorbent material, and regenerating solid sorbent particles by combustion of carbon containing deposits of said hydrovisbreaking operation.

13. A process according to claim 1 wherein said product of the visbreaking operation is separated from said major portion of the solid sorbent material by means comprising ballistic separation.

14. A process according to claim 2 wherein said vaporous gas oil containing products of said selective visbreaking operation are separated from said solid sorbent material by means comprising ballistic separation.

15. A process according to claim 3 wherein said immediate separation is effected by means comprising ballistic separation.

16. A process according to claim 4 wherein said product of said hydrovisbreaking operation is separated from said solid sorbent particulate by means comprising ballistic separation.

17. A process according to claim 12 wherein said step of separating vaporous hydrocarbons of said hydrovisbreaking operation from said solid particle sorbent material is accomplished by means comprising ballistic separation.

* * * * *